US006968671B2

(12) United States Patent
Dal Monte

(10) Patent No.: US 6,968,671 B2
(45) Date of Patent: Nov. 29, 2005

(54) LIGHTWEIGHT OMEGA CHAIN AND IMPROVED METHOD OF MANUFACTURE

(75) Inventor: Giuseppe A. Dal Monte, Burbank, CA (US)

(73) Assignee: Aurafin, LLC, Tamarac, FL (US)

( * ) Notice: Subject to any disclaimer, the term of this patent is extended or adjusted under 35 U.S.C. 154(b) by 67 days.

(21) Appl. No.: 10/984,137

(22) Filed: Nov. 8, 2004

(65) Prior Publication Data

US 2005/0086925 A1 Apr. 28, 2005

Related U.S. Application Data

(63) Continuation of application No. 10/407,317, filed on Apr. 4, 2003, now Pat. No. 6,860,097, which is a division of application No. 10/216,019, filed on Aug. 8, 2002, now Pat. No. 6,745,554, which is a continuation-in-part of application No. 10/157,952, filed on May 28, 2002, now abandoned.

(51) Int. Cl.[7] ..... B21L 17/00

(52) U.S. Cl. ..... 59/80; 59/35.1; 63/3; 29/896.411

(58) Field of Search ..... 59/30, 35.1, 29, 59/78, 79.1, 79.3, 80; 29/896.411; 63/3

(56) References Cited

U.S. PATENT DOCUMENTS

| | | | | |
|---|---|---|---|---|
| 1,694,703 A | | 12/1928 | Döppenschmitt | |
| 1,781,379 A | | 11/1930 | Forstner | |
| 1,784,582 A | | 12/1930 | Döppenschmitt | |
| 1,840,047 A | | 1/1932 | Mealy | |
| 1,840,771 A | * | 1/1932 | Duerr | 63/3 |
| 1,841,375 A | | 1/1932 | Meyer | |
| 1,849,741 A | | 3/1932 | Döppenschmitt | |
| 2,054,408 A | * | 9/1936 | Casey | 63/3 |
| 2,079,386 A | | 5/1937 | Schofer | 29/160.6 |
| 2,153,659 A | | 4/1939 | Bürk | 63/3 |
| 2,852,923 A | | 9/1958 | Gamelsky | 63/20 |
| 3,254,396 A | | 6/1966 | Mushey | 29/160.6 |
| 3,372,500 A | | 3/1968 | Claude | 40/21 |
| 3,844,136 A | | 10/1974 | Reith et al. | 63/4 |
| 3,994,126 A | | 11/1976 | Rieth | 59/79 R |
| 4,821,532 A | | 4/1989 | Jaques et al. | 63/3 |
| D316,831 S | | 5/1991 | Bulgari | D11/6 |
| 5,441,686 A | | 8/1995 | Jackl et al. | 264/152 |
| 5,606,874 A | | 3/1997 | Archetti et al. | 63/21 |
| 5,611,144 A | | 3/1997 | Gusky | 29/896.411 |
| 5,816,072 A | | 10/1998 | Michaels | 63/3 |
| 6,094,939 A | | 8/2000 | Gavello | 63/3 |
| 6,105,357 A | | 8/2000 | Weinberg | 59/35.1 |
| 6,460,323 B1 | * | 10/2002 | Rosenwasser et al. | 59/80 |
| 6,745,554 B2 | * | 6/2004 | Dal Monte | 59/35.1 |
| 6,860,097 B2 | * | 3/2005 | Dal Monte | 59/80 |

* cited by examiner

*Primary Examiner*—David Jones
(74) *Attorney, Agent, or Firm*—Cislo & Thomas, LLP; Daniel M. Cislo

(57) ABSTRACT

A method of manufacturing jewelry and a chain article formed therefrom that results in a product substantially lighter than its solid counterpart. A length of wire mesh or woven wire type of "fabric" having a hollow seamed wire with a non-precious core of a width and length corresponding generally to the proportions of the jewelry chain to be created is provided. The non-precious core is then removed by one of many methods. Then, a series of hollow link sections are received on the length of wire mesh such that the interior surfaces of the links surround the mesh. The links are arranged in an end-to-end abutting relationship upon the mesh until the length of chain desired is reached. Alternatively, a spiral resembling a spring may be used. Upper and lower die members are brought into contact with the preformed chain and forced there against with a magnitude of pressure and for a duration of time sufficient to deform the links or spiral and bring the inner surfaces thereof into at least partial engagement with the mesh.

22 Claims, 3 Drawing Sheets

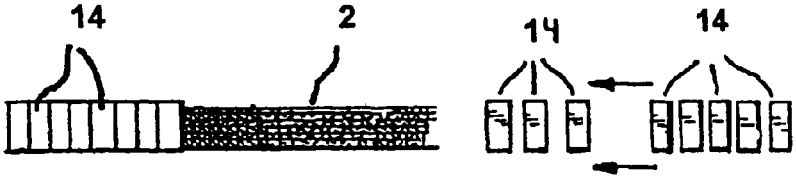
FIG. 6
FIG. 7
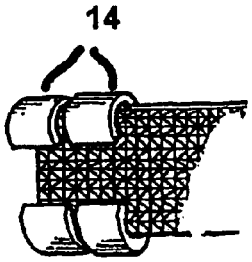
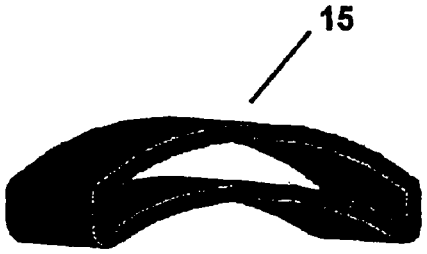
FIG. 8
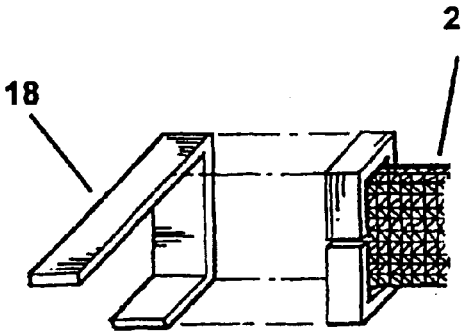
FIG. 9

LIGHTWEIGHT OMEGA CHAIN AND IMPROVED METHOD OF MANUFACTURE

CROSS-REFERENCES TO RELATED APPLICATIONS

This patent application is a continuation application of divisional application Ser. No. 10/407,317 filed Apr. 4, 2003 now U.S. Pat. No. 6,860,097, which is a divisional application of Ser. No. 10/216,019 now U.S. Pat. No. 6,745,554 B2, filed Aug. 8, 2002, which is a continuation-in-part of Ser. No. 10/157,952, filed May 28, 2002 for LIGHTWEIGHT OMEGA CHAIN AND IMPROVED METHOD OF MANUFACTURE, now abandoned.

BACKGROUND OF THE INVENTION

1. Field of the Invention

This invention relates generally to the field of jewelry, and more particularly relates to an ornamental jewelry chain wherein the chain is flexible, made of segmented portions with a hollow core mesh.

2. Description of the Related Art

The style of jewelry chain that this invention pertains is commonly referred to as "omega." To manufacture an omega-style chain, a flexible substrate, such as a woven wire mesh sheet, is provided. The woven mesh is threaded into a plurality of independent links in an end-to-end abutting relation. The thus preformed chain section is placed between the upper and lower dies of a press. The links are then generally uniformly pressed onto the substrate, causing the links to deflect and come into substantial contact with the substrate. The resulting cross sectional shape of the chain is dictated by the contour of the upper and lower dies of the press. The finished chain remains contiguous, but is flexible due to the fact that the links are independent of one another and are supported by the flexible mesh substrate. In this manner, very attractive jewelry items have been created that appear rigid, but are flexible and thus appealing to the wearer and resistant to permanent deformation and disfigurement. The core of these jewelry chains is made out of a solid precious metal creating an undesirably heavy piece of jewelry.

In general, the manufacturing of OMEGA chains is very expensive because OMEGA chains are generally very heavy and are made out of precious metals such as gold, platinum and various metal alloys. With the high cost of gold and other precious metals, it has become extremely expensive to manufacture jewelry using these materials. Furthermore, the average consumer acquisitive capacity has suffered a decline, such decline being felt by the average individual jewelry manufacturer in most developed countries. Jewelry manufacturers in general and the jewelry chain manufacturers in particular have focused and long sought to create products that appear aesthetically similar to the heavier product of solid gold chains but are much lighter in weight (and sought to reduce the amount of precious metal involved in the application). This similarity is achieved by using a lesser amount of precious material content in the jewelry object being manufactured without altering the appearance and look of such heavier jewelry objects.

Therefore, it would be desirable to manufacture jewelry that looks aesthetically similar to the OMEGA style jewelry, but weighs much lighter and costs much less to manufacture.

SUMMARY OF THE INVENTION

A method of manufacturing a decorative chain that is attractive, flexible and lightweight is described. The steps involve first providing a length of woven wire mesh made with a hollow seamed wire with a non precious core, and then removing the non precious core by a process selected from a group consisting of chemical, thermal and mechanical removal. The materials used for the non precious core can be selected from a group consisting of aluminum, steel, copper and any other suitable material or materials. Then after passing a series of independent link segments over the woven wire mesh, the link segments are arranged in an end-to-end abutting relationship to form a preformed chain. These link segments can have identical or varying widths.

In another embodiment, a plate can be wrapped over the woven wire mesh, the plate being arranged in a side-to-side abutting relationship to form a preformed chain. Next, the preformed chain can be placed between die members of a press and the working surfaces of the die members can be brought into contact with the link segments, subjecting the preformed chain to a pressing force for a duration of time. The duration of time that is needed is such that is sufficient to cause the link segments to deform into a configuration corresponding to the contour of the die members.

In yet another embodiment, rather than independent link segments a series of spirals is used, preferably made from a continuous thin plate or flattened wire and resembling a spring. The woven wire mesh is introduced inside the spiral, and the decorative chain preferably formed as described above.

OBJECTS OF THE INVENTION

It is, therefore, a principal object of this invention to provide ornamental, flexible jewelry chain that is substantially lighter, but maintains the look and appearance of an 'OMEGA' and can be made into a necklace, bracelet or any other chain-type jewelry.

It is another object of the present invention to reduce the cost of OMEGA style jewelry products by reducing the amount of precious metal required to construct the jewelry product.

These and other objects and advantages of the present invention will be apparent from a review of the following specification and accompanying drawings.

BRIEF DESCRIPTION OF THE DRAWINGS

FIG. 6 illustrates preformed links being slid over a mesh substrate during assembling of jewelry chain in accordance with this invention.

FIG. 7 is a back perspective view of a portion of a jewelry chain manufactured utilizing alternatively-shaped link segments.

FIG. 8 is a perspective view of a single link, without the wire mesh, after it is formed and shaped into the final state.

FIG. 9 is a perspective view illustrating the process of assembling link segments simultaneously with the formation of a preformed chain.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
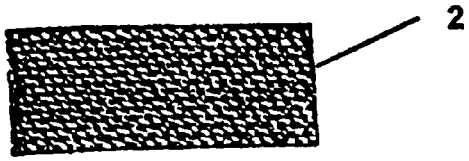
FIG. 1 is a view of a wire mesh made with a hollow wire in accordance with this invention.
Figure 2:
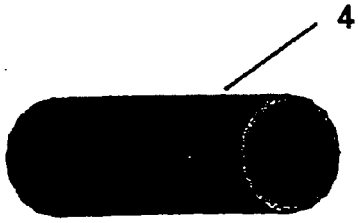
FIG. 2 is a perspective view of a seamless hollow wire cross section in accordance with this invention.

The present method in making Omega chains includes initially providing a length of hollow wire that is woven into a "fabric" or mesh 2, as shown in FIG. 1. This mesh 2 is very flexible and can be cut longitudinally to any desired width without losing the flexibility or continuity. The hollow wire can be made by any of the various well-known methods, such as being made out of a seamless tube 4, as shown in FIG. 2, or being made with a non-precious metal core that is chemically, thermally or mechanically removed once the mesh 2 is made. This mesh 2 is generally made of a solid wire that is round in cross section, but could also be made with wires of different cross sections.

Another method of creating a hollow wire is by longitudinally wrapping a thin sheet of precious metal around a non precious metal round wire in a manner that a small seam or gap runs along the entire length of the wire so formed. This seam or gap allows the core to be etched out after the wire mesh is formed.

Figure 3:
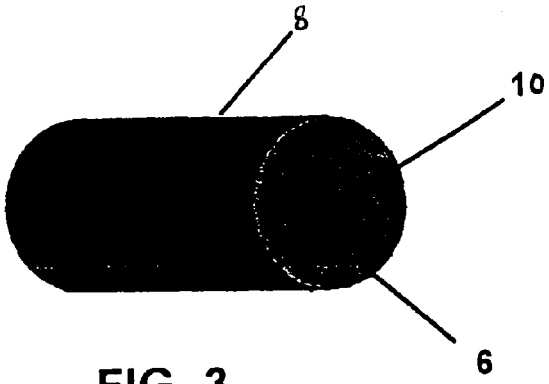
FIG. 3 is a perspective view of a hollow wire cross section with the non-precious metal core still in place in accordance with this invention.
Figure 4:
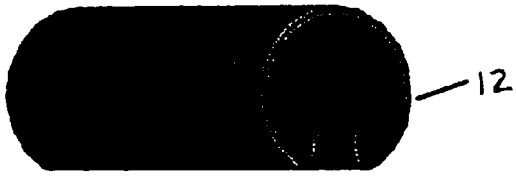
FIG. 4 is a perspective view of a hollow wire cross section without the non-precious metal core in accordance with this invention.

Yet another method of making a hollow wire suitable for making the hollow mesh 2 is one known as "aggraffato," as shown in FIGS. 3 and 4, where the longitudinal edges 6 of the precious metal 8 are embedded into the non-precious core 10. This method allows the manufacturing of hollow wire with any desirable wall thickness suitable for use in an automatic chain making machine. Because the precious metal 8 sheet is partially embedded into the core 10, it does not peel off when twisted or bent.

Figure 5:
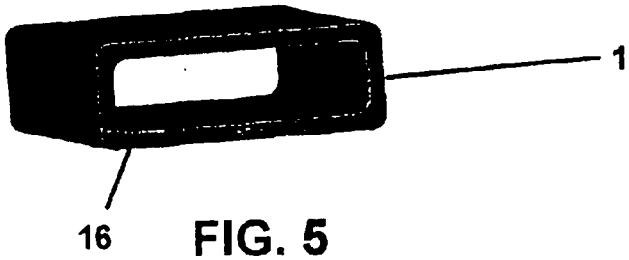
FIG. 5 is a perspective view of a single link, without the wire mesh.

The hollow wire 12, with or without the non-precious core 10, can be then woven into a mesh 2. The wire mesh 2 can be then cut into strips of the required width and the strips of mesh 2 can be then hammered or pressed to a desired width and thickness to fit the tubular links 14, as shown in FIG. 5. The pressing or hammering of the strips of the mesh 2 is done to uniform the width and thickness of the mesh 2 and also to avoid that any single element, a small segment of a spiral, would move from its position making the insertion of the mesh 2 into the links 14 extremely difficult.

Once the mesh 2 has been hammered or pressed to the proper size, the non-precious metal 10 can be removed or etched out. Common cores used in this process are aluminum, steel and/or copper and alloys thereof, however other suitable materials may be used. These cores can be easily etched out, using etching agents such as acids or caustic chemicals.

As shown in FIGS. 6 and 7, once the core 10 of the wire forming the mesh 2 has been removed, the mesh 2 itself can be inserted into a series of hollow link sections 14 such that the interior surfaces 16 of the links surround the hollow mesh 2. These link sections 14 are generally rectangular in cross-section and the width of the mesh 2 is generally the inner width of the links 14. It is important to note, however, that a chain of varying width can be manufactured. One example includes the use of mesh 2 and links 14 having a gradually changing width. Naturally, the upper and lower dies utilized to create the finished chain are configured to match. The links 14 can be arranged in an end-to-end abutting relationship upon the mesh 2, and this preformed chain can be placed between the upper and lower die members of a press. The magnitude of pressure and the duration of time that is sufficient to deform the links and bring the inner surfaces thereof into at least partial engagement with the mesh 2 can be used. An example of a single link 15 that is formed and shaped into the final state is shown at FIG. 8. The contour of the operating surfaces of the upper and lower dies may be of any desired shape and/or radius. It is also possible, by utilizing the present method, to create a chain having various cross sections, symmetric and asymmetric as well.

Figure 10:
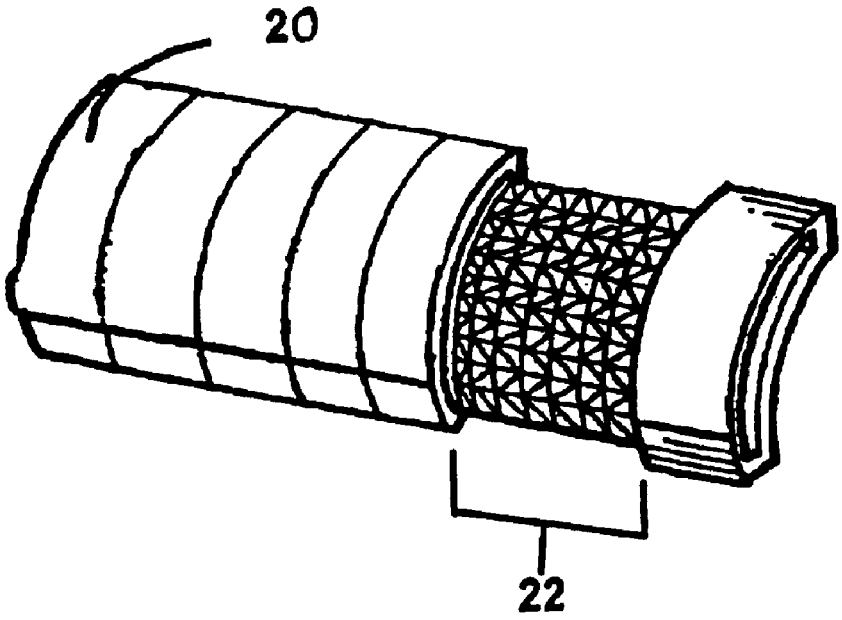
FIG. 10 is a partial exploded view of a finished jewelry chain manufactured in accordance with this invention.

As shown in FIG. 9, the link segments 18 may be in the form of box-like segments formed through a separate manufacturing process, or may be formed over the hollow mesh 2 from flat or staple-shaped links 18 that are wrapped around the hollow mesh 2 in a pre-pressing step or during the actual creation of the chain with the dies. In addition, it has been found to be desirable to first press the links 18 into contact with the mesh 2 with a lighter pressing force than what is to be used in a final pressing step, so as to secure the links 18 preliminarily to the mesh 2. This facilitates easier manipulation of the chain before final pressing/assembly, wherein the links 18 can be fit accurately together and the chain can be cleaned prior to the final pressing step. An example of a completed chain 20 having a portion 22 removed is shown in FIG. 10.

Figure 11:
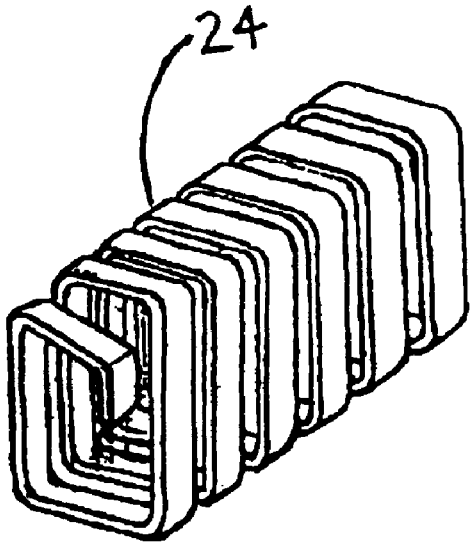
FIG. 11 is a perspective view illustrating an "avvolto" embodiment of this invention.

Another product that can be manufactured with a hollow wire mesh 2 is the one known as "avvolto," where the outside links are substituted by a spiral 24 made of a thin plate. Please see FIG. 11. In this case, the spiral 24 of generally rectangular cross section can be made from a continuous thin plate or flattened wire that also has a generally rectangular cross section. The spiral 24 formed resembles a tight spring having a rectangular cross section. The hollow wire mesh 2 can be introduced inside the spiral and the chain formed can be pressed in the same manner as described above. This pressing may be carried out by stamping, rolling, or any other suitable means.

While the present invention has been described with regards to particular embodiments, it is recognized that additional variations of the present invention may be devised without departing from the inventive concept.

What is claimed is:

1. A lightweight decorative chain comprising:

a plurality of link segments, each having a cross section, said links arranged in an end-to-end abutting relationship; and a flexible mesh fabricated of woven hollow wire of a precious metal, said mesh extending through said cross section of said link segments, wherein said link segments have gradually varying widths.

2. The chain of claim 1 wherein said cross section is generally closed.

3. The chain of claim 1 wherein said cross section of said link segments is generally crescent shaped.

4. The chain of claim 1 wherein said cross section of said link segment is generally rectangular shaped.

5. A lightweight decorative chain comprising:

a series of spirals having a cross-section; and a flexible mesh fabricated of woven hollow wire of a precious metal, said mesh extending through said cross-section of said series of spirals, wherein said series of spirals is fabricated of a continuous flat wire or thin plate.

6. The chain of claim 5, wherein the cross section is generally rectangular.

7. The chain of claim 5, wherein said series of spirals have gradually varying widths.

8. The chain of claim 5, wherein the cross section is generally crescent shaped.

9. The chain of claim 5, wherein said cross section is generally closed.

10. A lightweight decorative chain comprising:

a plurality of link segments, each having a cross section, said links arranged in an end-to-end abutting relationship; and a flexible mesh fabricated of woven hollow wire of a precious metal, said mesh extending through said cross section of said link segments, wherein said link segments have gradually varying widths, and wherein said cross section is generally closed.

11. A lightweight decorative chain comprising:

a plurality of spiral link segments, each having a cross section, said spiral link segments arranged in an end-to-end abutting relationship; and a flexible mesh fabricated of woven hollow wire of a precious metal, said mesh extending through said cross section of said spiral link segments.

12. The chain of claim 11 wherein said cross section is generally closed.

13. The chain of claim 11 wherein said cross section is generally crescent shaped.

14. The chain of claim 11 wherein said cross section of said spiral link segment is generally rectangular shaped.

15. The chain of claim 11, wherein the plurality of spiral link segments have gradually varying widths.

16. The chain of claim 11, wherein a spiral link segment is fabricated of a continuous flat wire.

17. The chain of claim 11, wherein a spiral link segment is fabricated of a thin plate.

18. The chain of claim 16, wherein said cross section is generally crescent shaped.

19. The chain of claim 16, wherein said cross section of said spiral link segment is generally rectangular shaped.

20. The chain of claim 16, wherein a spiral link segment is fabricated of a continuous flat wire.

21. The chain of claim 16, wherein a spiral link segment is fabricated of a thin plate.

22. A lightweight decorative chain comprising:

a plurality of spiral link segments, each having a cross section, said spiral link segments arranged in an end-to-end abutting relationship; and a flexible mesh fabricated of woven hollow wire of a precious metal, said mesh extending through said cross section of said link segments, wherein said link segments have gradually varying widths, and wherein said cross section is generally closed.

* * * * *